US011152747B2

(12) United States Patent
Shioda et al.

(10) Patent No.: US 11,152,747 B2
(45) Date of Patent: Oct. 19, 2021

(54) CONNECTOR

(71) Applicant: IRISO ELECTRONICS CO., LTD., Yokohama (JP)

(72) Inventors: Hideki Shioda, Yokohama (JP); Yoshihito Ohkuma, Yokohama (JP)

(73) Assignee: IRISO ELECTRONICS CO., LTD., Yokohama (JP)

( * ) Notice: Subject to any disclaimer, the term of this patent is extended or adjusted under 35 U.S.C. 154(b) by 0 days.

(21) Appl. No.: 16/753,472

(22) PCT Filed: Oct. 5, 2018

(86) PCT No.: PCT/JP2018/037449
§ 371 (c)(1),
(2) Date: Apr. 3, 2020

(87) PCT Pub. No.: WO2019/073933
PCT Pub. Date: Apr. 18, 2019

(65) Prior Publication Data

US 2020/0295511 A1 Sep. 17, 2020

(30) Foreign Application Priority Data

Oct. 10, 2017 (JP) ..... JP2017-196774

(51) Int. Cl.
*H01R 13/631* (2006.01)
*H01R 12/71* (2011.01)
*H01R 12/91* (2011.01)

(52) U.S. Cl.
CPC ..... *H01R 13/6315* (2013.01); *H01R 12/71* (2013.01); *H01R 12/91* (2013.01)

(58) Field of Classification Search
CPC ..... H01R 13/6315
USPC ..... 439/247, 248
See application file for complete search history.

(56) References Cited

U.S. PATENT DOCUMENTS 5,873,742 A 2/1999 McHugh
6,155,858 A * 12/2000 Ozawa ..... H01R 13/14 439/248
7,125,260 B2 * 10/2006 Orita ..... H01R 12/58 439/74
9,331,414 B2 5/2016 Doi et al.
9,484,656 B2 11/2016 Doi et al.
(Continued)

FOREIGN PATENT DOCUMENTS

CN 1764015 A 4/2006
CN 102474046 A 5/2012
(Continued)

OTHER PUBLICATIONS

International Search Report with English translation and Written Opinion for International Application No. PCT/JP2018/037449, dated Apr. 18, 2019, 8 pages.
(Continued)

*Primary Examiner* — Gary F Paumen
(74) *Attorney, Agent, or Firm* — Westman, Champlin & Koehler, P.A.

(57) ABSTRACT

A connector includes a movable housing, a fixed housing, plural signal terminals, and a pair of power source terminals. Each of the power source terminals is formed in an elongated shape with a length in a span direction as viewed along an insertion/removal direction, spans between a pair of sidewalls, includes a span direction intermediate portion retained by a terminal array direction end portion of the movable housing, and includes second elastic portions each capable of undergoing elastic deformation at a location positioned between the movable housing and the pair of sidewalls.

5 Claims, 14 Drawing Sheets

(56) References Cited

U.S. PATENT DOCUMENTS

| | | | | |
|---|---|---|---|---|
| 10,062,995 | B2 * | 8/2018 | Doi | H01R 12/91 |
| 10,522,927 | B2 | 12/2019 | Yoshida | |
| 2006/0089018 | A1 | 4/2006 | Orita et al. | |
| 2012/0135621 | A1 | 5/2012 | Hayauchi | |
| 2015/0044901 | A1 | 2/2015 | Doi et al. | |
| 2016/0204536 | A1 | 7/2016 | Doi et al. | |
| 2017/0170588 | A1 | 6/2017 | Doi | |
| 2019/0013608 | A1 | 1/2019 | Yoshida | |

FOREIGN PATENT DOCUMENTS

| | | | |
|---|---|---|---|
| CN | 104347991 | A | 2/2015 |
| CN | 107078426 | A | 8/2017 |
| JP | 2006-85944 | A | 3/2006 |
| JP | 2006-120448 | A | 5/2006 |
| JP | 2007220327 | A | 8/2007 |
| JP | 2011040206 | A | 2/2011 |
| JP | 2014-235974 | A | 12/2014 |
| JP | 2015-035352 | A | 2/2015 |
| JP | 5946804 | B2 | 7/2016 |
| JP | 2016-195056 | A | 11/2016 |
| JP | 6025196 | B2 | 11/2016 |
| WO | 2017115693 | A1 | 7/2017 |

OTHER PUBLICATIONS

Extended European search report for European Patent Application No. 18865877.7, dated Jun. 9, 2021, 9 pages.
First Office Action, including search report, for Chinese Patent Application No. 201880064745.0, dated Apr. 28, 2021, 10 pages.

* cited by examiner

CONNECTOR

CROSS-REFERENCE TO RELATED APPLICATION

This Application is a Section 371 National Stage Application of International Application No. PCT/JP2018/037449, filed on Oct. 5, 2018, entitled "CONNECTOR", which published as WO 2019073933 A1, on Apr. 18, 2019, and claims priority to Japanese Patent Application No. 2017-196774, filed on Oct. 10, 2017, the contents of which are incorporated herein by reference in their entireties.

TECHNICAL FIELD

The present invention relates to a connector, and more specifically relates to a connector including signal terminals and power source terminals, and in which a movable housing is capable of moving relative to a fixed housing.

BACKGROUND ART

Japanese Patent Application Laid-Open (JP-A) No. 2006-85944 discloses a board-to-board connector including signal terminals and power source terminals, and used to electrically connect circuit boards together. In this board-to-board connector, a socket attached to one circuit board is fitted together with a plug attached to another circuit board. The socket configures a movable connector. The socket includes a common housing (fixed housing) mounted to the one circuit board, and a signal terminal block and a pair of power source terminal blocks (each configuring a movable housing) disposed alongside each other with a predetermined gap therebetween. The signal terminal block is coupled to the common housing through the multiple signal terminals. The pair of power source terminal blocks are connected to the common housing through a pair of the power source terminals. The signal terminals and the power source terminals are provided with elastically deformable spring portions (elastic portions), and the signal terminal block and the pair of power source terminal blocks are capable of moving relative to the common housing. Fitting misalignment between the socket and the plug is thus absorbed.

SUMMARY OF INVENTION

Technical Problem

Smaller connectors for attachment to circuit boards are demanded accompanying the reduction in size of electronic components in recent years. Employing a connector including both signal terminals and power source terminals as in the background art enables installation space required by the connector on the circuit board to be reduced in comparison to cases in which a connector including signal terminals and a connector including power source terminals are attached to the circuit board separately to each other.

However, in the background art described above, the signal terminal block (movable housing) is disposed at a terminal array direction intermediate portion of the common housing (fixed housing), and the power source terminal blocks (also movable housing) are respectively provided at each terminal array direction end portion of the common housing. This results in an increased size of the common housing in the terminal array direction, and a larger overall configuration of the connector in the terminal array direction.

In consideration of the above circumstances, an object of the present invention is to obtain a connector capable of achieving a reduction in size of the overall configuration in a terminal array direction, in a configuration including both signal terminals and power source terminals and in which a movable housing is capable of moving relative to a fixed housing.

Solution to Problem

A connector of a first aspect includes a movable housing, a fixed housing, plural signal terminals, and a pair of power source terminals. The movable housing is configured to have a connection target inserted into and removed from the movable housing. The fixed housing is fixed to a circuit board and includes a pair of sidewalls respectively disposed on each side in a span direction orthogonal to an insertion/removal direction of the connection target with respect to the movable housing. The plural signal terminals are arrayed in a terminal array direction orthogonal to both the insertion/removal direction and the span direction. Each of the signal terminals spans along the span direction between the movable housing and a respective sidewall of the pair of sidewalls and includes a first elastic portion capable of undergoing elastic deformation at a span direction intermediate portion of the signal terminal. The pair of power source terminals are respectively disposed on each side of the plural signal terminals in the terminal array direction. Each of the power source terminals is formed in an elongated shape with a length in the span direction as viewed along the insertion/removal direction, spans between the pair of sidewalls, includes a span direction intermediate portion retained by a terminal array direction end portion of the movable housing, and includes second elastic portions each capable of undergoing elastic deformation at a location positioned between the movable housing and the pair of sidewalls.

In the connector of the first aspect, the fixed housing fixed to the circuit board includes the pair of sidewalls respectively disposed on each side in the span direction orthogonal to the insertion/removal direction of the connection target in which the connection target is inserted into and removed from the movable housing. The plural signal terminals and the pair of power source terminals span along the span direction between the movable housing and the pair of sidewalls. The plural signal terminals are arrayed in the terminal array direction orthogonal to both the insertion/removal direction and the span direction, and the span direction intermediate portion of each signal terminal includes the first elastic portion capable of undergoing elastic deformation. The pair of power source terminals are respectively disposed on each side of the plural signal terminals in the terminal array direction, and span between the pair of sidewalls. Each of the power source terminals includes the span direction intermediate portion retained by the terminal array direction end portion of the movable housing, and the second elastic portions each capable of undergoing elastic deformation at a location positioned between the movable housing and the pair of sidewalls.

In this connector, the first elastic portions of the signal terminals and the pair of second elastic portions of each of the power source terminals undergo elastic deformation so as to permit movement of the movable housing relative to the fixed housing. Moreover, in the connector, the plural signal terminals and the pair of power source terminals span between the common movable housing and the fixed housing, thereby enabling placement space required for the movable housing in the terminal array direction to be reduced in comparison to configurations in which plural movable housings are arranged along the terminal array direction. Moreover, since the power source terminals are each formed in an elongated shape with length along the span direction as viewed along the insertion/removal direction, the placement space required by the power source terminals in the terminal array direction can be reduced. Due to the above, the connector of the present aspect enables a reduction in size of the overall configuration in the terminal array direction.

A connector of a second aspect is the first aspect, wherein each of the power source terminals includes a contact portion, a pair of the second elastic portions, and a pair of connection portions. The contact portion is provided at the span direction intermediate portion and is configured to form an electrical contact with the connection target and to undergo elastic deformation toward the plurality of signal terminals. The pair of second elastic portions respectively extend toward each side in the span direction from the contact portion. The pair of connection portions respectively extend toward an outer side in the terminal array direction from respective end portions of the pair of second elastic portions on an opposite side from the contact portion, the pair of connection portions being retained by the fixed housing and fixed to the circuit board.

In the connector of the second aspect, the contact portion provided at the span direction intermediate portion of each of the power source terminals is retained by the terminal array direction end portion of the movable housing. Since the contact portion makes electrical contact with the connection target and undergoes elastic deformation toward the plural signal terminals, there is no need to secure a space for elastic deformation of the contact portion on the opposite side to the plural signal terminals (on the terminal array direction outer side). Moreover, the pair of second elastic portions of each of the power source terminals respectively extend toward each span direction side from the contact portion, thereby enabling a placement space for the pair of second elastic portions in the terminal array direction to be set smaller. Moreover, the pair of connection portions of each of the power source terminals respectively extend toward the terminal array direction outer side (toward the opposite side to the plural signal terminals) from the respective end portions of the pair of second elastic portions on the opposite side to the contact portion. Setting the extension direction of the pair of connection portions in this manner enables the contact portion and the pair of second elastic portions to be disposed closer to the plural signal terminals than in a configuration in which the pair of connection portions extend toward the plural signal terminals from the end portions of the pair of second elastic portions on the opposite side to the contact portion. As a result, the movable housing that retains the contact portion at the terminal array direction end portion can be reduced in size along the terminal array direction. Due to the above, the connector of the present aspect enables a further reduction in size of the overall configuration in the terminal array direction.

A connector of a third aspect is the second aspect, wherein the terminal array direction end portions of the movable housing are each formed with a housing recess opening toward the outer side in the terminal array direction and configured to house at least a part of a respective contact portion.

In the connector of the third aspect, the terminal array direction end portions of the movable housing are each formed with the housing recess opening toward the terminal array direction outer side. At least part of the contact portion of the respective power source terminal is housed in the housing recess. This makes it easier to secure placement space for the contact portion when reducing the size of the overall configuration of the connector in the terminal array direction.

A connector of a fourth aspect is the second or the third aspect, wherein the terminal array direction end portions of the movable housing are each formed with a pair of spring housing recesses respectively opening toward a respective outer side in the terminal array direction and each outer side in the span direction, and configured to house at least a part of a respective second elastic portion of the pair of second elastic portions.

In the connector of the fourth aspect, the terminal array direction end portions of the movable housing are each formed with the pair of spring housing recesses respectively opening toward the terminal array direction outer side and the span direction outer side. At least part of the respective second elastic portion out of the pair of second elastic portions of each of the power source terminals is housed in the pair of spring housing recesses. This makes it easier to secure placement space for the pair of second elastic portions when reducing the size of the overall configuration of the connector in the terminal array direction.

Advantageous Effects of Invention

As described above, the connector according to the present invention enables a reduction in size of the overall configuration in the terminal array direction in a configuration including both signal terminals and power source terminals and in which the movable housing is capable of moving relative to the fixed housing.

DESCRIPTION OF EMBODIMENTS

Figure 1:
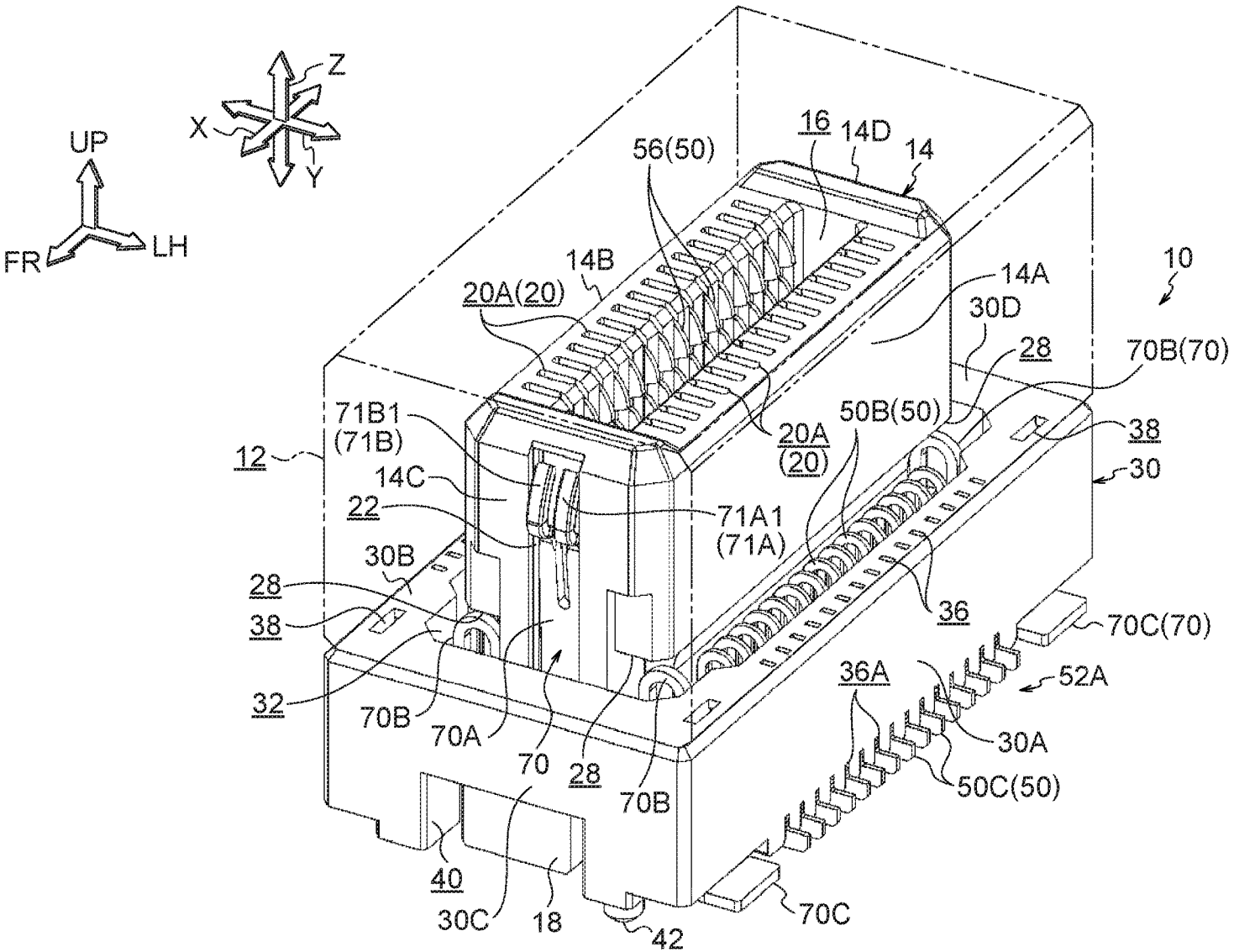
FIG. 1 is a perspective view illustrating a connector according to an exemplary embodiment of the present invention.
Figure 2:
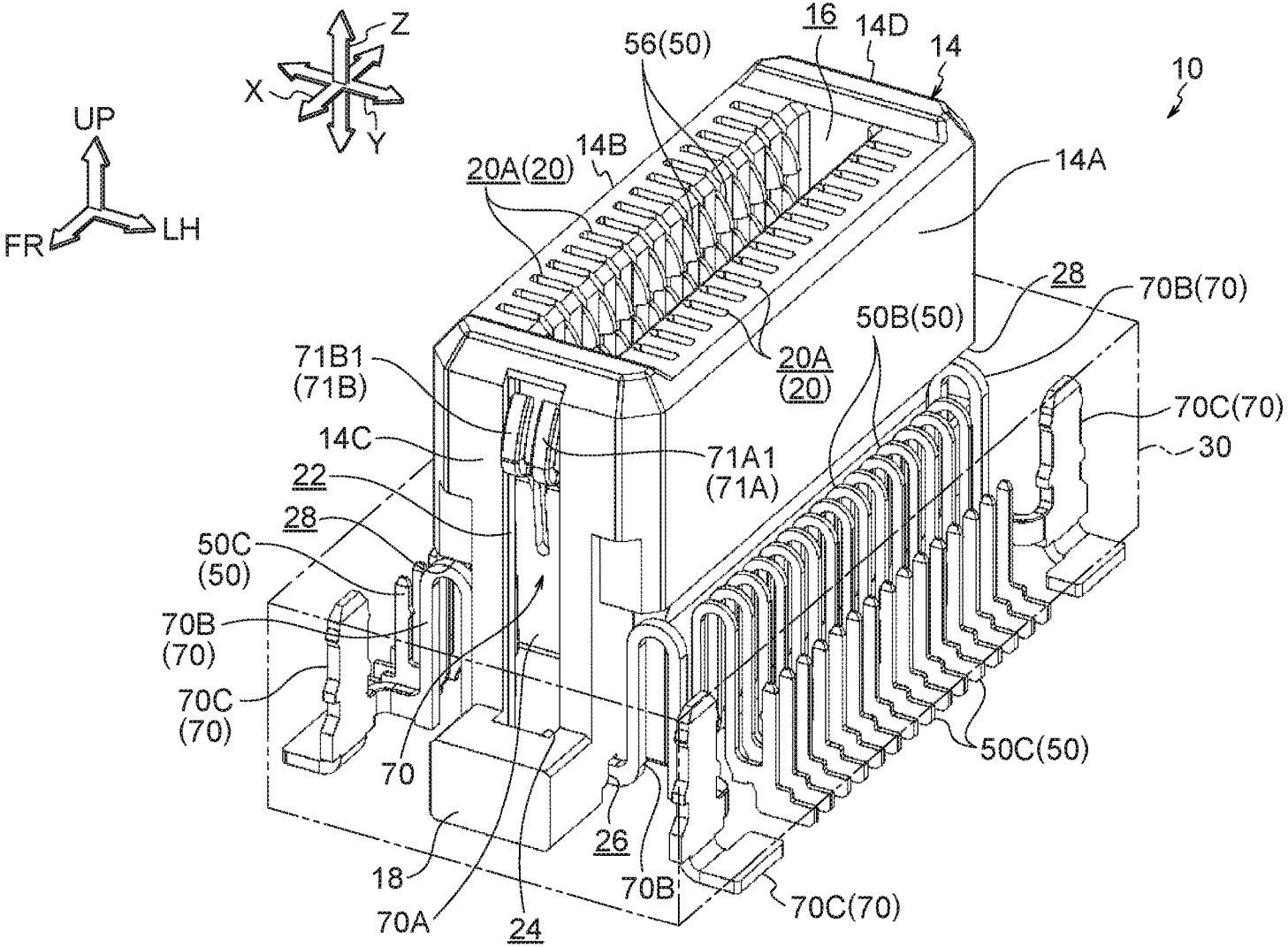
FIG. 2 is a perspective view corresponding to FIG. 1, illustrating a connector according to an exemplary embodiment of the present invention with a fixed housing in a see-through state.
Figure 3:
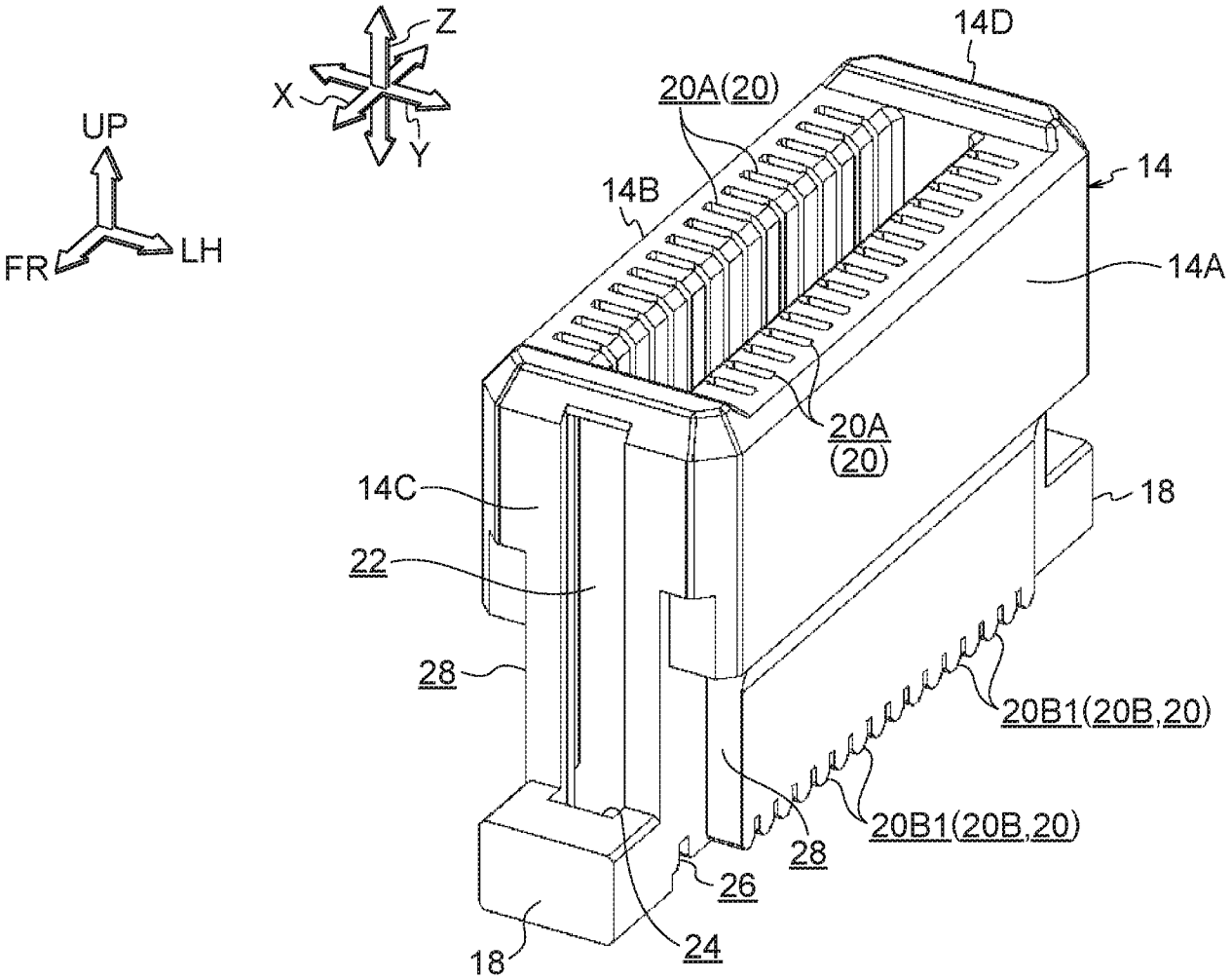
FIG. 3 is a perspective view illustrating a movable housing according to an exemplary embodiment of the present invention.
Figure 4:
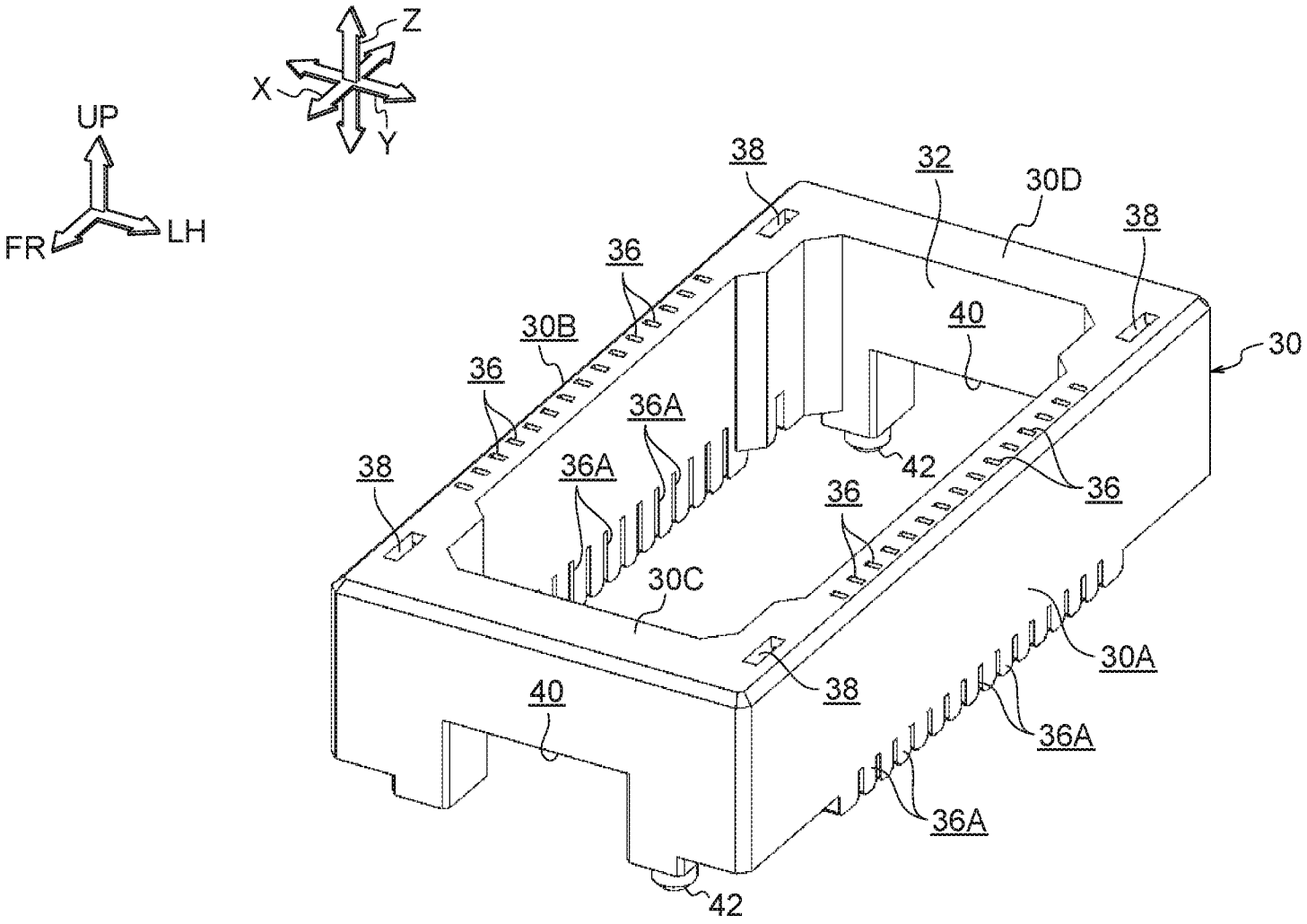
FIG. 4 is a perspective view illustrating a fixed housing according to an exemplary embodiment of the present invention.
Figure 5:
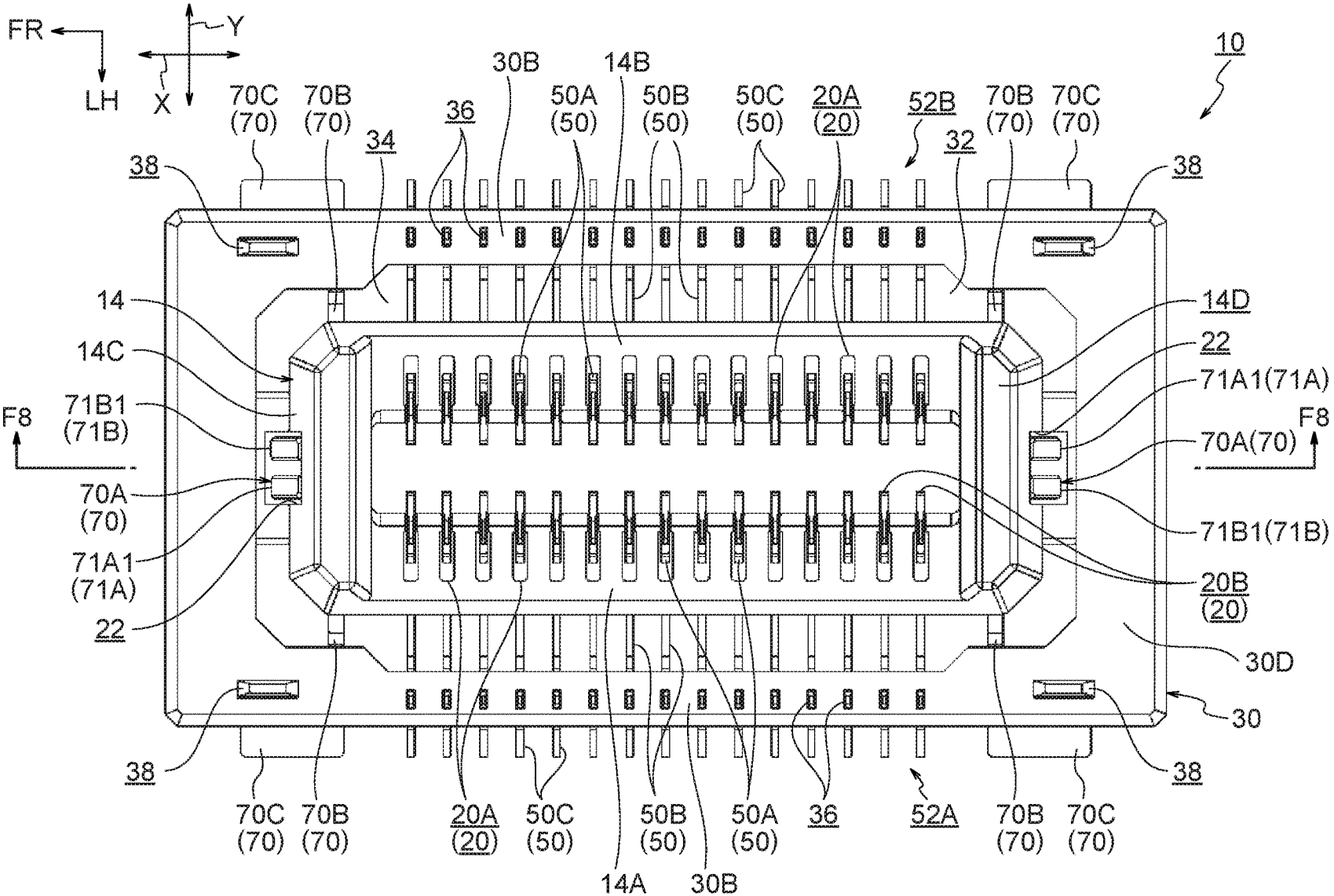
FIG. 5 is a plan view illustrating a connector according to an exemplary embodiment of the present invention.
Figure 6:
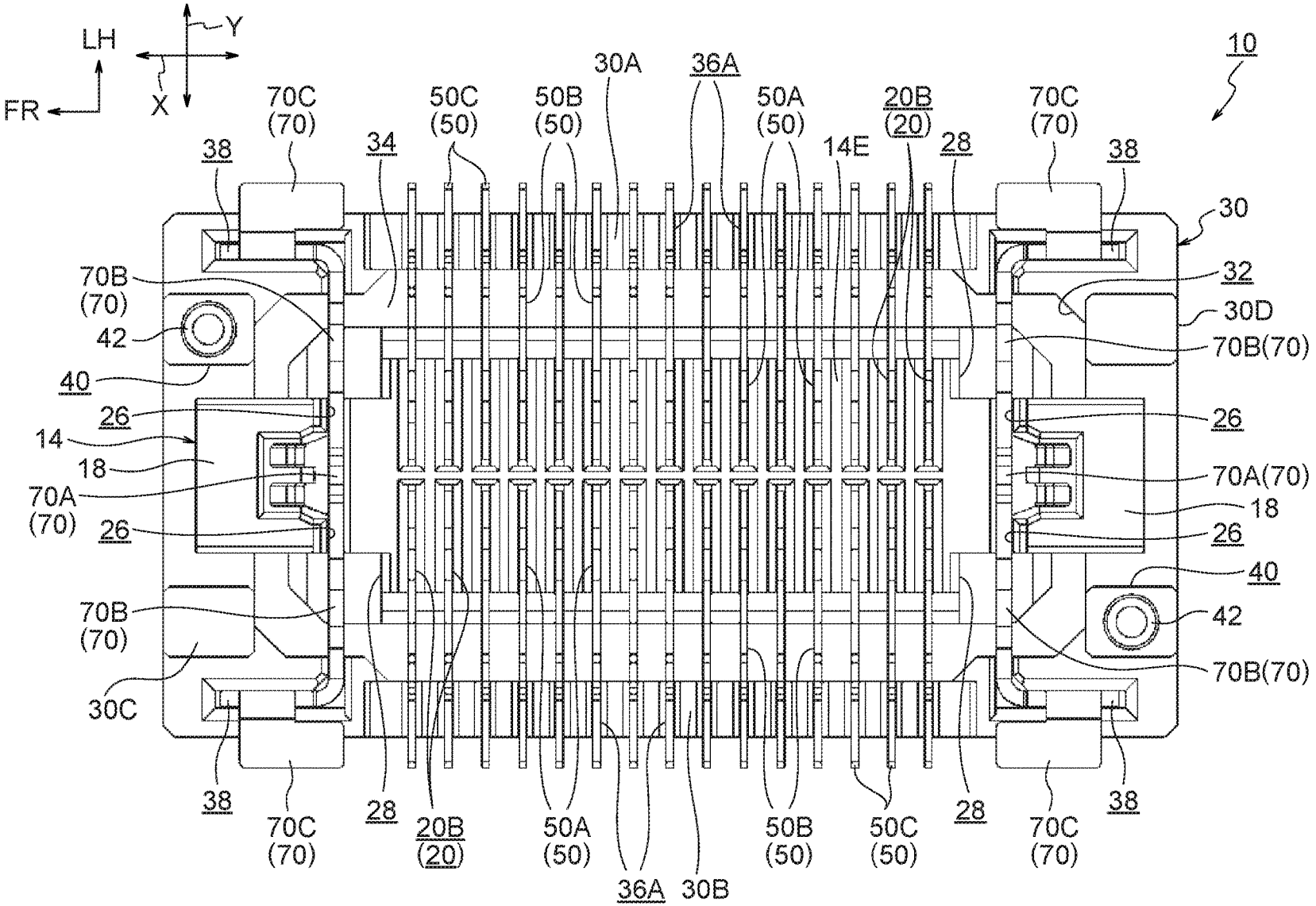
FIG. 6 is a bottom face view illustrating a connector according to an exemplary embodiment of the present invention.
Figure 7:
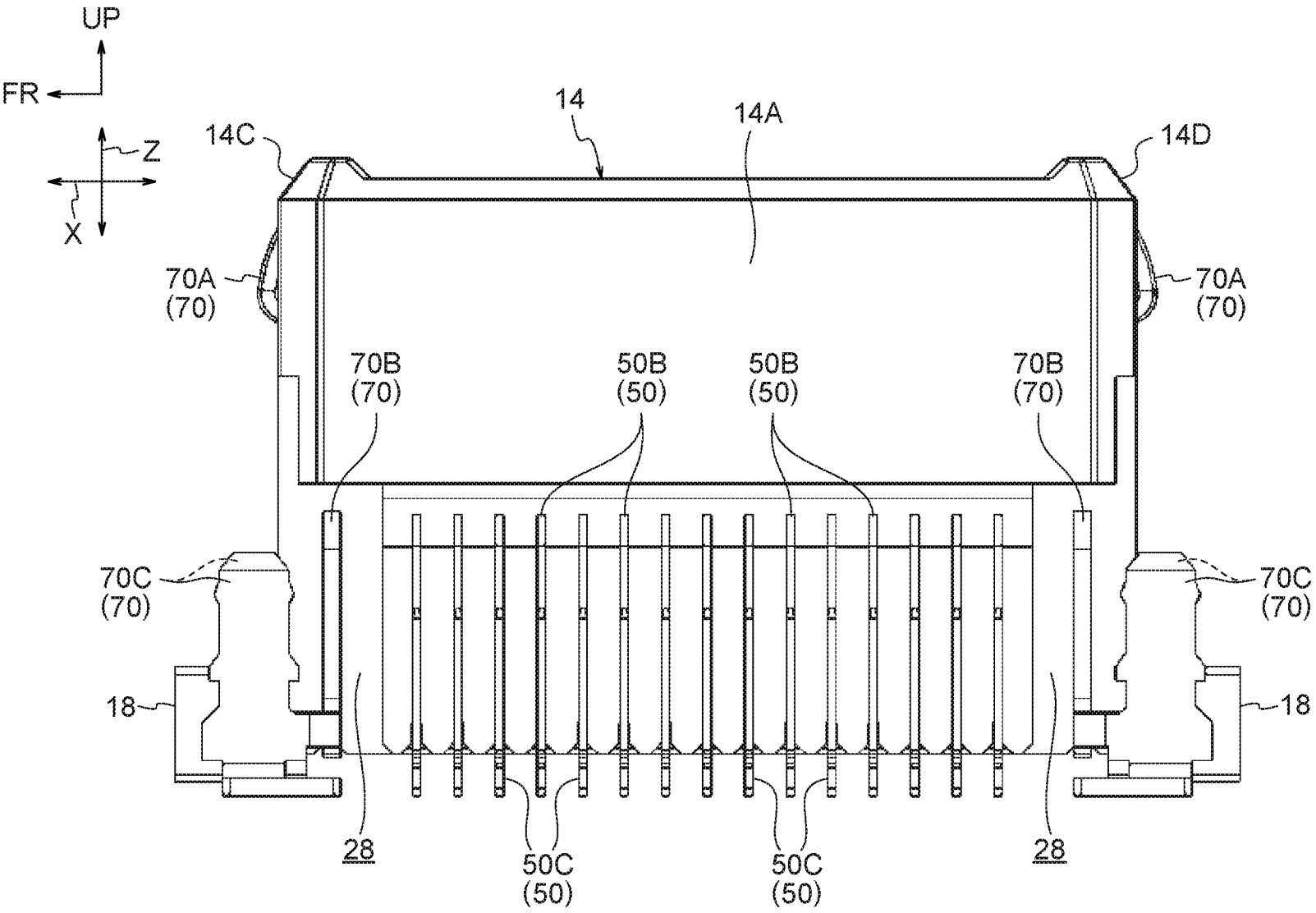
FIG. 7 is a side view illustrating a connector according to an exemplary embodiment of the present invention.
Figure 8:
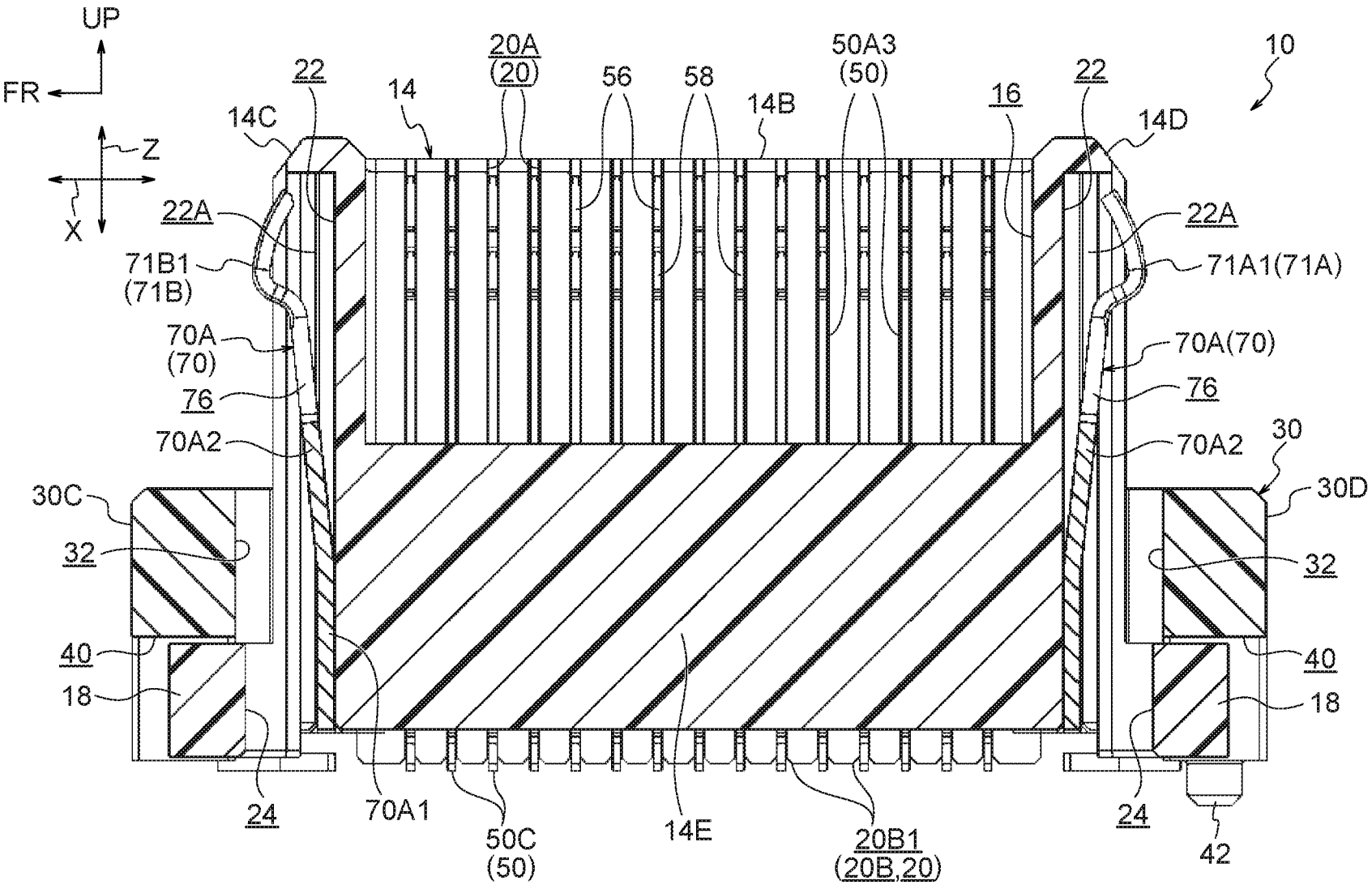
FIG. 8 is a cross-section illustrating a plane sectioned along line F8-F8 in FIG. 5.

Explanation follows regarding a connector 10 according to an exemplary embodiment of the present invention, with reference to FIG. 1 to FIG. 14. For ease of explanation, in the drawings, the arrow FR indicates the front of the connector 10, the arrow LH indicates the left of the connector 10, and the arrow UP indicates upward with respect to the connector 10, as appropriate. In the following explanation, reference simply to front, rear, left, right, upward, and downward directions is understood to refer to the directions relative to the connector 10. These directions are unrelated to directions relative to the connector 10 when in use. In the drawings, some reference numerals may be omitted in the interests of simplicity.

Configuration

As illustrated in FIG. 1 to FIG. 8, the connector 10 according to the present exemplary embodiment is what is referred to as a movable (floating) connector, and includes a movable housing 14, to and from which a counterpart connector 12, serving as a connection target (not illustrated in the drawings, with the exception of FIG. 1) is inserted and removed, and a fixed housing 30 that is fixed to a non-illustrated circuit board. The fixed housing 30 includes a pair of sidewalls 30A, 30B respectively disposed on each side of the movable housing 14 in a span direction (arrow Y direction) orthogonal to an insertion/removal direction (arrow Z direction) of the counterpart connector 12 with respect to the movable housing 14.

The connector 10 further includes plural signal terminals 50 arrayed in a terminal array direction (arrow X direction) orthogonal to both the insertion/removal direction Z and the span direction Y so as to span along the span direction Y between the movable housing 14 and the respective sidewall out of the pair of sidewalls 30A, 30B, and a pair of power source terminals 70 respectively disposed on each side of the plural signal terminals 50 in the terminal array direction X so as to span along the span direction Y between the movable housing 14 and the pair of sidewalls 30A, 30B.

The connector 10 configures a plug (male terminal) of a board-to-board connector, and the counterpart connector 12 configures a receptacle (female terminal) fixed to a counterpart circuit board, this being different from the above-mentioned circuit board. The counterpart connector 12 is provided with plural non-illustrated counterpart signal terminals to form an electrical connection with the plural signal terminals 50, and a pair of non-illustrated counterpart power source terminals to form an electrical connection with the pair of power source terminals 70.

Note that the connection target of the connector 10 is not limited to the counterpart connector 12, and may be a busbar or a square pin header. In the present exemplary embodiment, the insertion/removal direction Z corresponds to the up-down direction of the connector 10, the span direction Y corresponds to the left-right direction of the connector 10, and the terminal array direction X corresponds to the front-rear direction of the connector 10. In the following explanation, the insertion/removal direction Z is sometimes referred to as the up-down direction, the span direction Y is sometimes referred to as the left-right direction, and the terminal array direction X is sometimes referred to as the front-rear direction. The connector 10 is formed with a symmetrical profile in the front-rear direction and in the left-right direction.

Movable Housing

As illustrated in FIG. 1 to FIG. 3 and FIG. 5 to FIG. 8, the movable housing 14 is formed in a substantially rectangular tube shape with a closed bottom (a substantially rectangular block shape) including an upward-opening rectangular closed-bottom hole 16. The movable housing 14 is integrally provided with a pair of left and right sidewalls 14A, 14B opposing each other in the left-right direction, a pair of front and rear coupling walls 14C, 14D linking respective front-rear direction end portions of the left and right sidewalls 14A, 14B together along the left-right direction, and a bottom wall 14E (see FIG. 8) linking the left and right sidewalls 14A, 14B together in the left-right direction and linking the front and rear coupling walls 14C, 14D together in the front-rear direction. The left and right sidewalls 14A, 14B each extend along the front-rear direction, and the front and rear coupling walls 14C, 14D each extend along the left-right direction. The bottom wall 14E is provided substantially corresponding to the lower half of the movable housing 14 with thickness in the up-down direction. The movable housing 14 is, for example, manufactured from an insulating material such as a synthetic resin. Note that although the movable housing 14 according to the present exemplary embodiment is formed in an elongated shape with its length in the front-rear direction, the front-rear direction dimension of the movable housing 14 may be modified as appropriate depending on the number of the signal terminals 50.

Lower end portions of the front and rear coupling walls 14C, 14D (both front and rear end portions of the movable housing 14) are formed with a pair of front and rear engagement protrusions 18 respectively projecting toward a front-rear direction outer side (a terminal array direction X outer side). Each of the front and rear engagement protrusions 18 is formed in a rectangular block shape.

Faces of the left and right sidewalls 14A, 14B facing toward the closed-bottom hole 16 are formed with plural signal terminal insertion grooves 20A extending along the up-down direction at uniform intervals in the front-rear direction. Each of the signal terminal insertion grooves 20A opens toward the closed-bottom hole 16 and toward the upper side. The signal terminal insertion grooves 20A are in communication with plural signal terminal insertion holes 20B that penetrate the bottom wall 14E in the up-down direction. Lower end portions of the plural signal terminal insertion holes 20B configure groove shaped grooved portions 20B1. Each of the grooved portions 20B1 opens onto the left-right direction side of the respective sidewall 14A, 14B. The signal terminal insertion grooves 20A and the signal terminal insertion holes 20B are each formed in an elongated shape with length along the left-right direction as viewed along the up-down direction, and together configure signal terminal insertion portions 20.

Housing recesses 22 that each open toward the respective front-rear direction outer side are formed to a left-right direction central portion of each of the front and rear coupling walls 14C, 14D. The front and rear housing recesses 22 extend in the up-down direction, and are in communication with rectangular through holes 24 formed in base end portions of the engagement protrusions 18. The through holes 24 penetrate the base end portions of the engagement protrusions 18 in the up-down direction. A lower end portion of each of the housing recesses 22 is in communication with a pair of left and right elastic portion insertion grooves 26 formed in a lower face of the movable housing 14. The left and right elastic portion insertion grooves 26 extend along the left-right direction and open toward both sides in the left-right direction. Both left-right direction sides of substantially the lower halves of the front and rear coupling walls 14C, 14D are formed with spring housing recesses 28. The pairs of left and right spring housing recesses 28 are respectively open toward each front-rear direction outer side and also each left-right direction outer side.

Fixed Housing

As illustrated in FIG. 1, FIG. 2, and FIG. 4 to FIG. 8, the fixed housing 30 is formed in a substantially rectangular frame shape penetrated in the up-down direction by a rectangular through hole 32. The fixed housing 30 is integrally provided with the pair of left and right sidewalls 30A, 30B opposing each other in the left-right direction, and a pair of front and rear coupling walls 30C, 30D linking together both front-rear direction end portions of the left and right sidewalls 30A, 30B in the left-right direction. The left and right sidewalls 30A, 30B extend in the front-rear direction, and the front and rear coupling walls 30C, 30D extend in the left-right direction. The fixed housing 30 is, for example, manufactured from an insulating material such as a synthetic resin. Note that although the fixed housing 30 according to the present exemplary embodiment is formed in an elongated shape with length in the front-rear direction, the front-rear direction dimension of the fixed housing 30 may be modified as appropriate depending on the number of signal terminals 50.

Substantially the lower half of the movable housing 14 is inserted inside the through hole 32 in the fixed housing 30, and substantially the upper half of the movable housing 14 is disposed at the upper side of (outside) the fixed housing 30. A gap 34 that has a substantially rectangular ring shape as viewed along the up-down direction (not illustrated in the drawings, with the exception of FIG. 5 and FIG. 6) is formed between an inner peripheral face at the through hole 32 in the fixed housing 30 and an outer peripheral face of the substantially lower half of the movable housing 14.

Plural signal terminal insertion holes 36 are arranged at uniform intervals in the front-rear direction so as to penetrate front-rear direction intermediate portions of the left and right sidewalls 30A, 30B in the up-down direction. Power source terminal insertion holes 38 are formed penetrating both front-rear direction end portions of each of the left and right sidewalls 30A, 30B in the up-down direction. Lower end portions of the plural signal terminal insertion holes 36 configure grooved portions 36A. The grooved portions 36A are groove shaped, and open toward both left-right direction sides of the sidewalls 30A, 30B. Each of the front and rear power source terminal insertion holes 38 is formed in an elongated shape with length in the front-rear direction as viewed along the up-down direction.

Engagement recesses 40 that are recessed toward the upper side are respectively formed in lower parts of left-right direction intermediate portions of the front and rear coupling walls 30C, 30D. The front and rear engagement protrusions 18 formed to the movable housing 14 are disposed in the front and rear engagement recesses 40. An upper face of each of the engagement protrusions 18 either contacts an upper face of the corresponding engagement recess 40, or opposes the upper face of the corresponding engagement recess 40 from close range. The engagement protrusions 18 and the engagement recesses 40 function as stoppers to prevent the movable housing 14 from detaching from the fixed housing 30 toward the upper side. Gaps are formed between both left and right side faces of the respective engagement protrusion 18 and both left and right side faces of the respective engagement recess 40 to permit movement of the movable housing 14 relative to the fixed housing 30.

Positioning bosses 42 are formed projecting toward the lower side from lower faces of the front and rear coupling walls 30C, 30D. The front positioning boss 42 is disposed on the left side of the front engagement recess 40, and the rear positioning boss 42 is disposed on the right side of the rear engagement recess 40. The front positioning bosses 42 are fitted into positioning holes formed in the circuit board.

Signal Terminals

Figure 9:
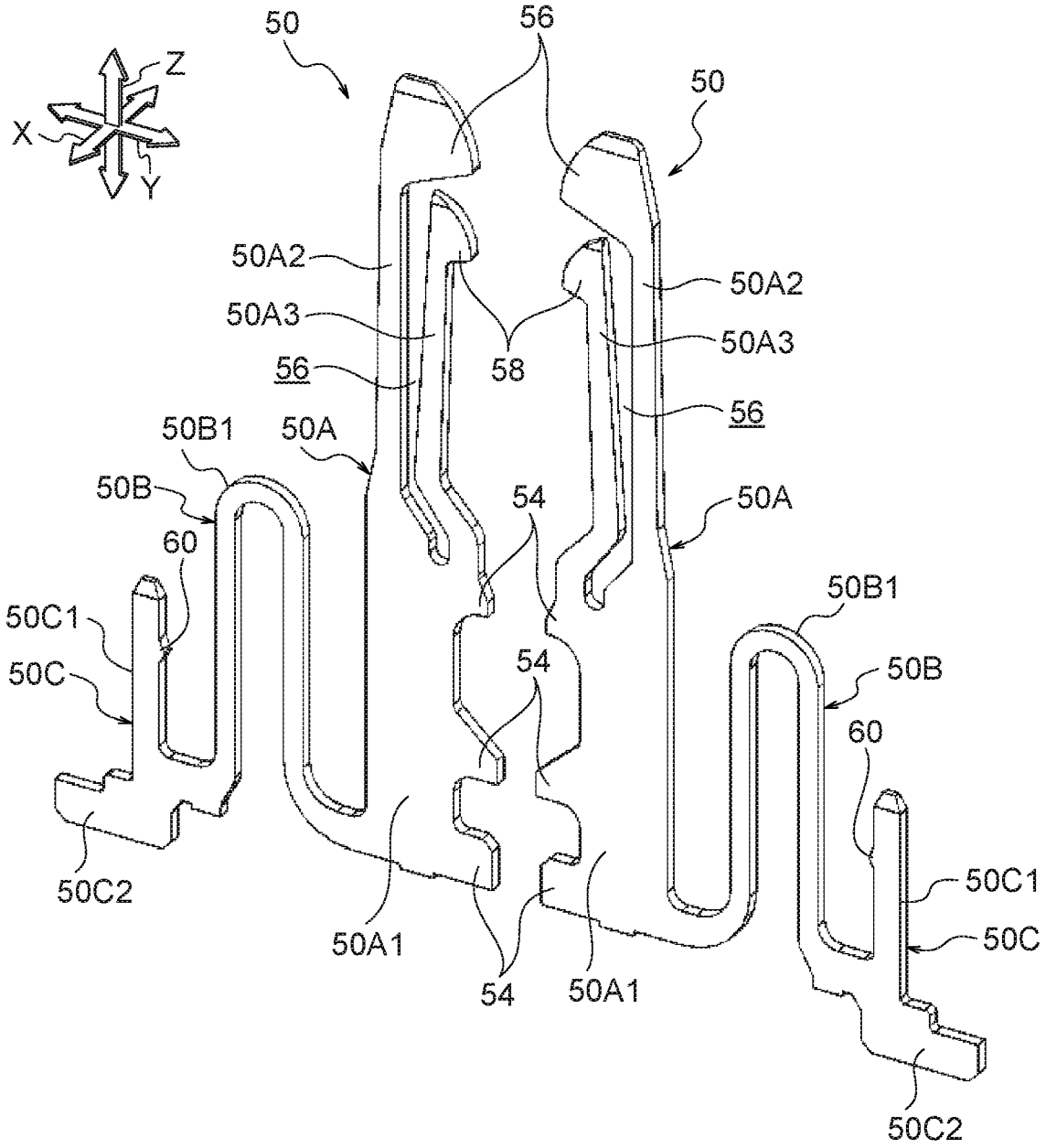
FIG. 9 is a perspective view illustrating signal terminals according to an exemplary embodiment of the present invention.
Figure 10:
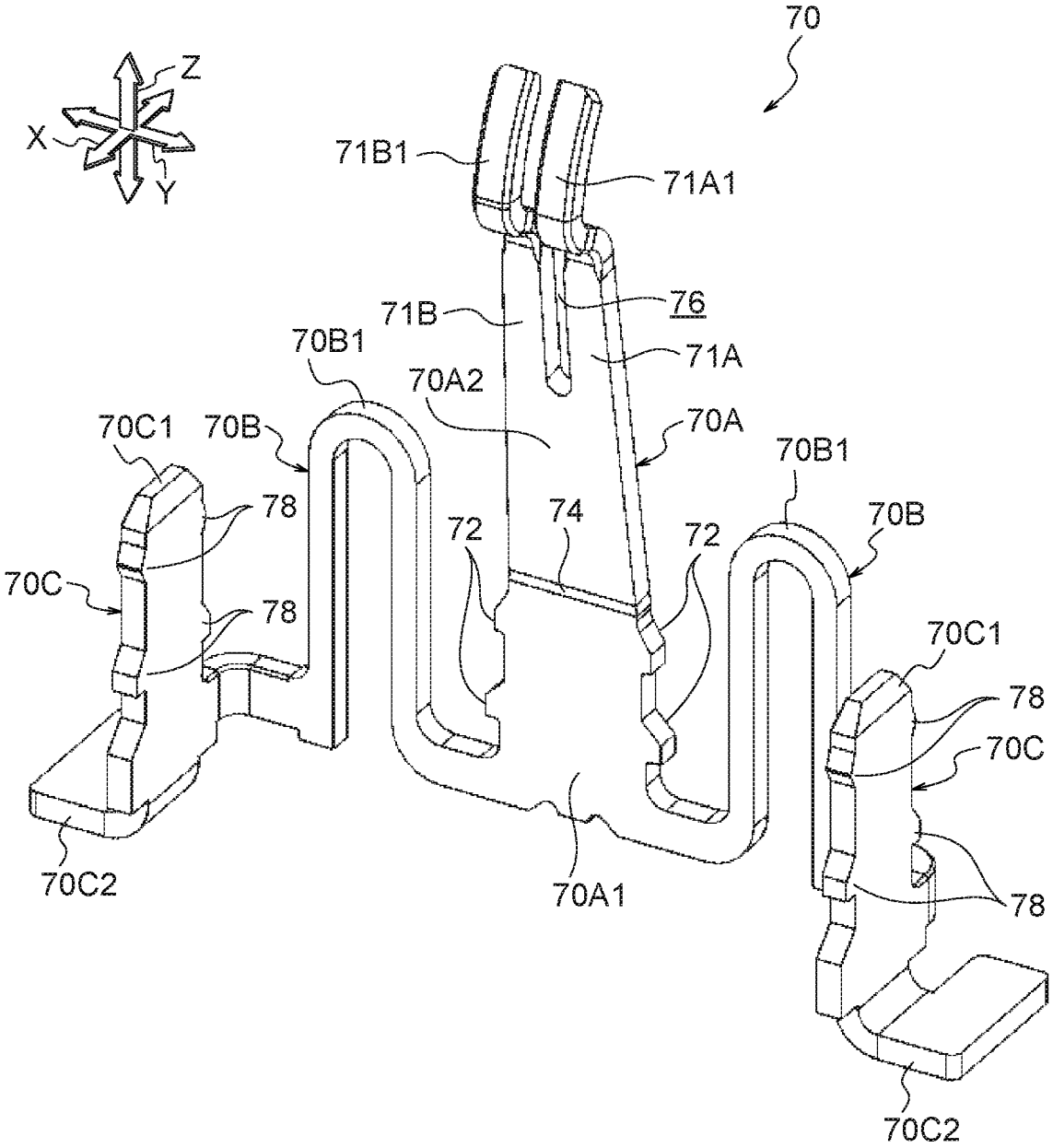
FIG. 10 is a perspective view illustrating a power source terminal according to an exemplary embodiment of the present invention.
Figure 11:
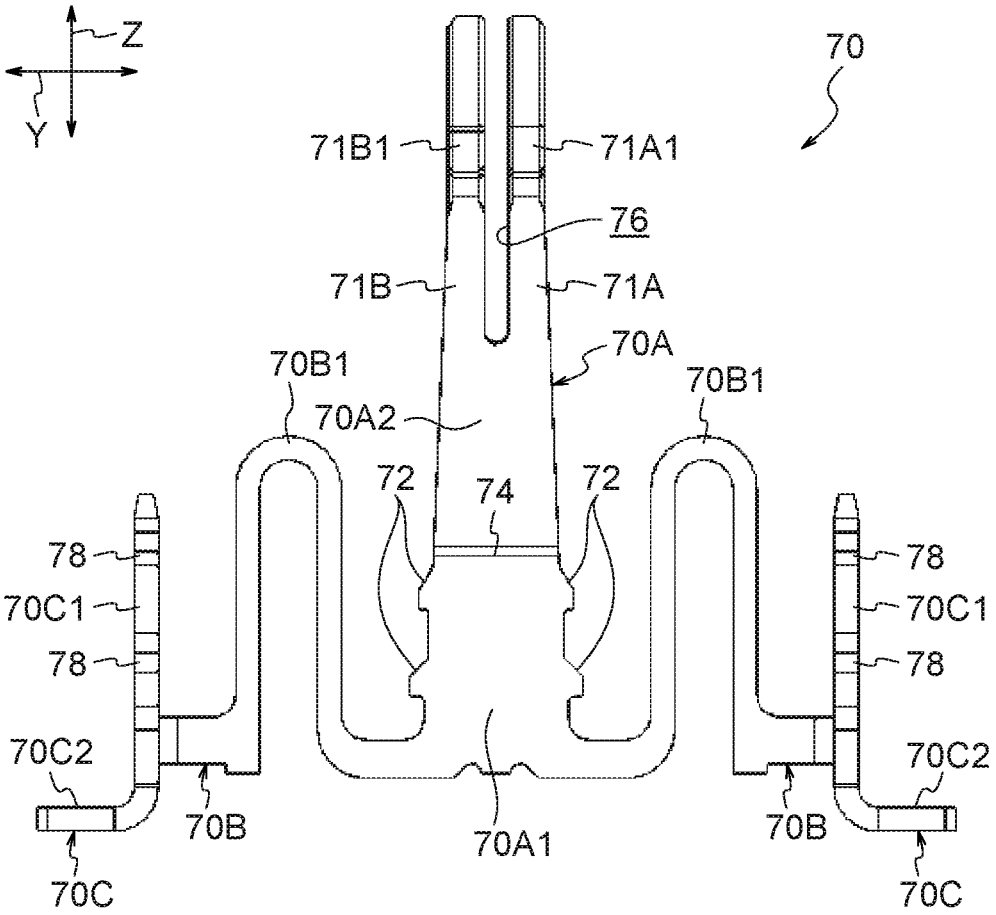
FIG. 11 is a front view illustrating a power source terminal according to an exemplary embodiment of the present invention.
Figure 12:
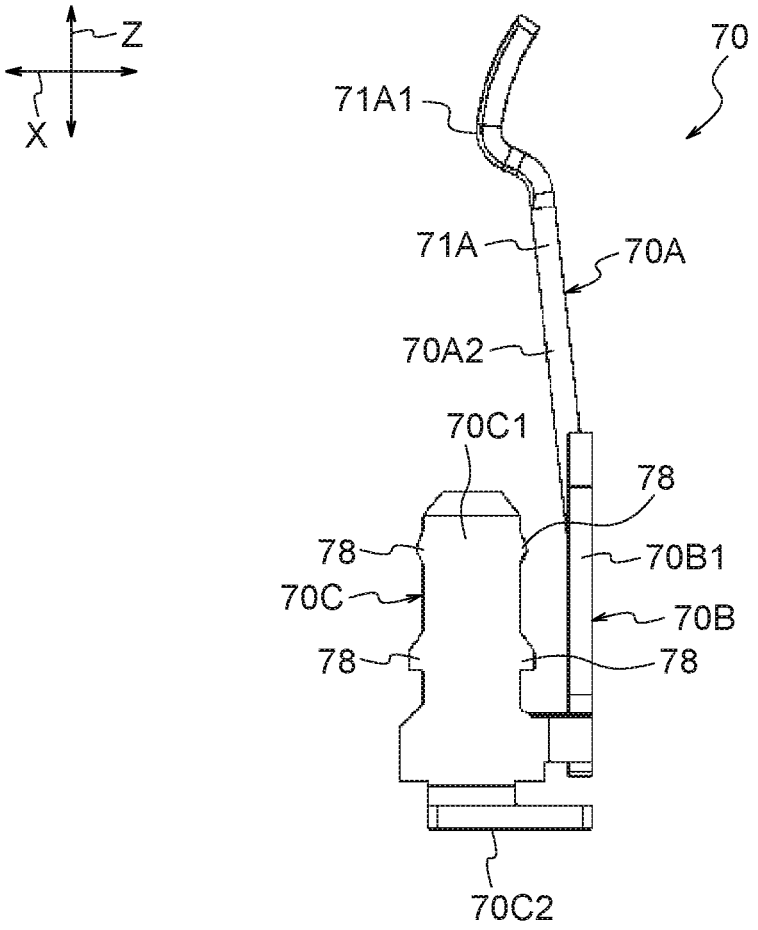
FIG. 12 is a side view illustrating a power source terminal according to an exemplary embodiment of the present invention.
Figure 13:
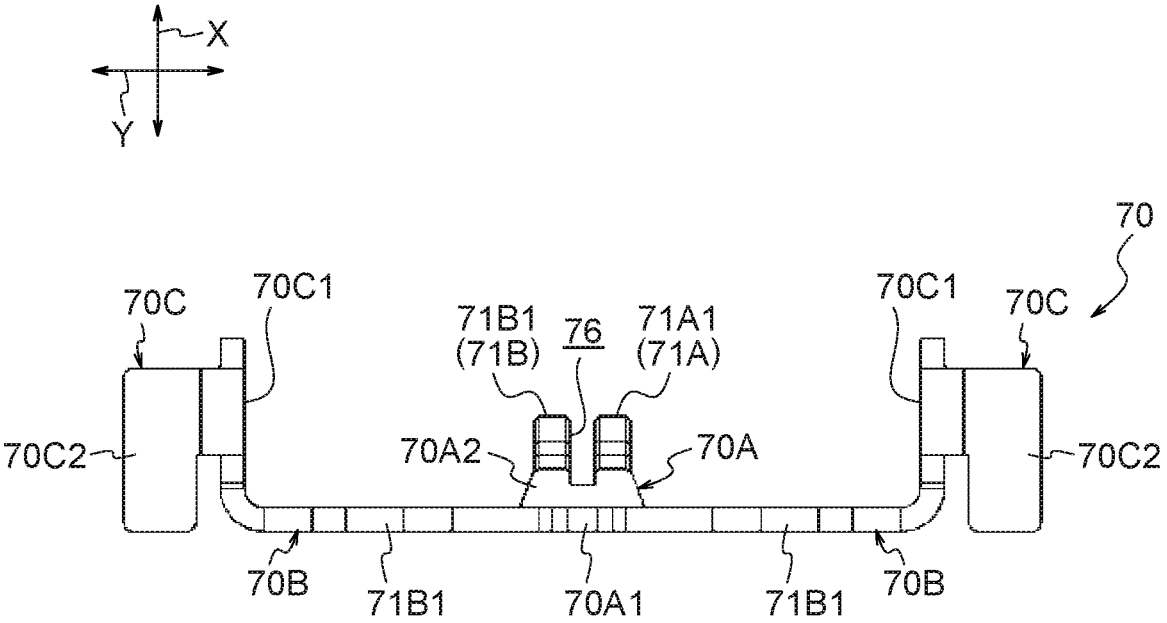
FIG. 13 is a bottom face view illustrating a power source terminal according to an exemplary embodiment of the present invention.
Figure 14:
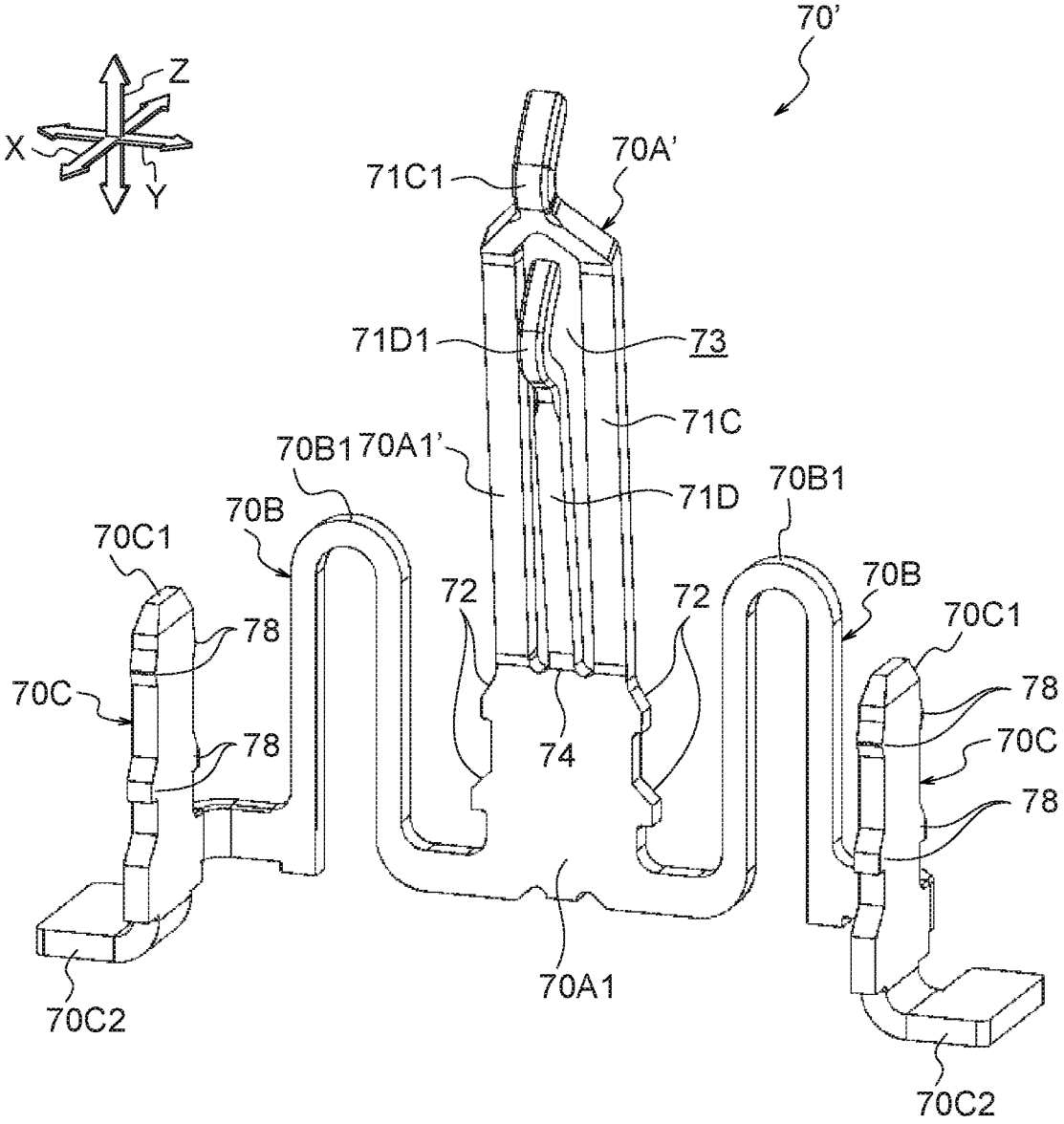
FIG. 14 is a perspective view corresponding to FIG. 10, illustrating a modified example of a power source terminal.

As illustrated in FIG. 1, FIG. 2, and FIG. 5 to FIG. 9, the plural signal terminals 50 are manufactured by punching a predetermined shape from an electrically conductive metal sheet, and are configured as a pair of left and right terminal arrays 52A, 52B. In each of the left and right terminal arrays 52A, 52B, the plural signal terminals 50 are arranged at uniform intervals in the front-rear direction. The plural signal terminals 50 of the left terminal array 52A and the plural signal terminals 50 of the right terminal array 52B are formed in the same shape as each other, but are disposed orientated in opposite directions to each other with respect to the left-right direction. The plural signal terminals 50 of the left terminal array 52A span along the left-right direction between the left sidewall 30A of the fixed housing 30 and the movable housing 14, and the plural signal terminals 50 of the right terminal array 52B span along the left-right direction between the right sidewall 30B of the fixed housing 30 and the movable housing 14. Note that FIG. 9 illustrates one of the signal terminals 50 of the left terminal array 52A and one of the signal terminals 50 of the right terminal array 52B.

Each of the signal terminals 50 includes a first contact portion 50A that are retained by the movable housing 14 and that undergoes elastic deformation toward the left-right direction outer side on making electrical contact with a counterpart signal terminal provided at the counterpart connector 12, a first elastic portion 50B that extends toward the left-right direction outer side from the first contact portion 50A and is capable of undergoing elastic deformation, and a first connection portion 50C that extends toward the left-right direction outer side from an end portion of the first elastic portion 50B on the opposite side to the first contact portion 50A and is retained by the fixed housing 30 and fixed to the circuit board.

The first contact portion 50A is formed in an elongated plate shape with its thickness direction in the front-rear direction and its length direction in the up-down direction. The first contact portion 50A is inserted into the corresponding signal terminal insertion portion 20 of the movable housing 14 from the lower side. Substantially the lower half of the first contact portion 50A configures a first retained portion 50A1 that is inserted (press-fitted) into the corresponding signal terminal insertion hole 20B of the movable housing 14. The first retained portion 50A1 is formed with plural claws 54 that project toward the left-right direction central side of the movable housing 14 and are arranged along the up-down direction. The plural claws 54 dig into an inner peripheral face at the signal terminal insertion hole 20B such that the first retained portion 50A1 is retained in the movable housing 14.

Substantially the upper half of the first contact portion 50A configures a pair of left and right first contact point elastic portions 50A2, 50A3, divided from each other in the left-right direction by a slit 56 extending along the up-down direction. The first contact point elastic portions 50A2, 50A3 are inserted into the corresponding signal terminal insertion groove 20A of the movable housing 14, and are capable of undergoing elastic deformation in the left-right direction. The first contact point elastic portion 50A2 on the left-right direction outer side extends further toward the upper side than the first contact point elastic portion 50A3 on the left-right direction central side. Upper end portions of the left and right first contact point elastic portions 50A2, 50A3 are formed with first contact points 56, 58 that project into the closed-bottom hole 16 of the movable housing 14. The first contact points 56, 58 contact the corresponding counterpart signal terminal provided at the counterpart connector 12. The signal terminal 50 is thereby electrically connected to the counterpart signal terminal. Even if one out of the first contact points 56, 58 is damaged, this electrical connection is secured by the other out of the first contact points 56, 58.

The first connection portion 50C includes a first press-fit portion 50C1 that is inserted (press-fitted) into the corresponding signal terminal insertion hole 36 of the fixed housing 30 from the lower side, and a first connection tab 50C2 that extends toward the left-right direction outer side from a lower end of the first press-fit portion 50C1, and is inserted into the grooved portion 36A of the signal terminal insertion hole 36. The first connection portion 50C thus has a substantially L-shaped profile as viewed along the front-rear direction. An upper portion of the first press-fit portion 50C1 is formed with a claw 60 projecting toward the left-right direction central side of the fixed housing 30. The claw 60 hooks onto an inner peripheral face at the signal terminal insertion hole 36, such that the first press-fit portion 50C1 is retained by the fixed housing 30. The first connection tab 50C2 projects further to the left-right direction outer side than the fixed housing 30. The first connection tab 50C2 is fixed (electrically connected) to the circuit board by soldering or the like.

The first elastic portion 50B configures a left-right direction intermediate portion of the signal terminal 50, and extends integrally from a lower end of the first contact portion 50A toward the left-right direction outer side. The first connection portion 50C extends integrally to the first elastic portion 50B from an end portion of the first elastic portion 50B on the opposite side to the first contact portion 50A. A left-right intermediate portion of the first elastic portion 50B configures a first spring portion 50B1 that is bent into an upward protrusion (toward a removal direction of the counterpart connector 12). The first spring portion 50B1 is configured in an inverted U-shape opening toward the lower side as viewed along the front-rear direction.

Power Source Terminals

As illustrated in FIG. 1, FIG. 2, FIG. 5 to FIG. 8, and FIG. 10 to FIG. 13, the pair of power source terminals 70 are manufactured by being punched out of an electrically conductive metal sheet and bent. The pair of power source terminals 70 are respectively disposed on each front-rear direction side of the plural signal terminals 50. The pair of power source terminals 70 are formed in the same shape as each other, but are disposed oriented in opposite directions to each other with respect to the front-rear direction. Each of the power source terminals 70 is formed in an elongated shape with length in the left-right direction as viewed along the up-down direction, and spans between the pair of sidewalls 30A, 30B. Left-right direction intermediate portions of the power source terminals 70 are retained by front-rear direction end portions of the movable housing 14. The power source terminals 70 each include second elastic portions 70B that each are capable of undergoing elastic deformation at a location positioned between the movable housing 14 and the pair of sidewalls 30A, 30B. Note that although the up-down direction dimension of each of the power source terminals 70 is set slightly shorter than the left-right direction dimension of each of the power source terminals 70 in the present exemplary embodiment, there is no limitation thereto. The up-down direction dimension of each of the power source terminals 70 may be modified as appropriate in accordance with the specifications of the connector 10 and the like, and each of the power source terminals 70 may be formed in an elongated shape with length in the up-down direction (insertion/removal direction Z) as viewed along the front-rear direction (the terminal array direction X).

A second contact portion 70A is provided at a left-right direction intermediate portion (left-right direction central portion) of each of the power source terminals 70. The second contact portion 70A undergoes elastic deformation toward the plural signal terminals 50 on making electrical contact with the counterpart power source terminal provided at the counterpart connector 12. Each of the power source terminals 70 includes a pair of the second elastic portions 70B extending toward the respective side in the left-right direction from the second contact portion 70A, and a pair of left and right second connection portions 70C respectively extending toward the front-rear direction outer side from respective end portions of the left and right second elastic portions 70B on the opposite side to the second contact portion 70A. The left and right second connection portions 70C are retained by the fixed housing 30 and fixed to the circuit board. The first contact portions 70A correspond to a "contact portion" of the present invention, and the second connection portions 70C correspond to a "connection portion" of the present invention. These are described in detail below.

The second contact portion 70A is formed in an elongated plate shape with its plate thickness direction in the front-rear direction and its length direction in the up-down direction. A plate thickness dimension of the second contact portion 70A in the front-rear direction is set smaller than a width dimension of the second contact portion 70A in the left-right direction. Part of the second contact portion 70A (a large part, excluding left and right second contact points 71A1, 71B1, described later) is housed within the corresponding housing recess 22 of the movable housing 14. A lower portion of the second contact portion 70A configures a second retained portion 70A1. The second retained portion 70A1 is inserted (press-fitted) into a lower portion of the corresponding housing recess 22 of the movable housing 14. The second retained portion 70A1 is formed with plural claws 72 that respectively project toward each left-right direction side and are arranged along the up-down direction. The plural claws 72 dig into left and right side faces of the housing recess 22 such that the second retained portion 70A1 is retained in the movable housing 14.

An up-down direction intermediate and upper portion of the second contact portion 70A configures a second contact point elastic portion 70A2 that is capable of undergoing elastic deformation in the front-rear direction. The second contact point elastic portion 70A2 extends from an up-down direction intermediate portion to an upper portion within the housing recess 22. The second contact point elastic portion 70A2 is formed with a left-right direction width that decreases slightly on progression upward, and is disposed in a non-contact state with respect to the left and right side faces of the housing recess 22. A bent portion 74 is formed between the second contact point elastic portion 70A2 and the second retained portion 70A1, such that the second contact point elastic portion 70A2 is slightly inclined toward the front-rear direction outer side on progression upward with respect to the up-down direction. A gap 22A (see FIG. 8) to allow the second contact point elastic portion 70A2 to undergo elastic deformation toward the plural signal terminals 50 (toward the front-rear direction central side of the movable housing 14) is thus formed between the second contact point elastic portion 70A2 and a bottom face of the housing recess 22.

An upper portion of the second contact point elastic portion 70A2 is divided into a pair of left and right divided portions 71A, 71B by a slit 76 extending along the up-down direction. Upper portions of the left and right divided portions 71A, 71B are provided with the second contact points 71A1, 71B1 that bulge in a substantially circular arc shape toward the front-rear direction outer side. The second contact points 71A1, 71B1 project toward the front-rear direction outer side of the housing recess 22, and contact the corresponding counterpart power source terminal provided at the counterpart connector 12. The power source terminal 70 is thereby electrically connected to the counterpart power source terminal. Even if one out of the second contact points 71A1, 71B1 is damaged, this electrical connection is secured by the other out of the second contact points 71A1, 71B1. Note that there is no limitation to a configuration in which the upper portion of the second contact point elastic portion 70A2 is divided into the left and right divided portions 71A, 71B (the left and right second contact points 71A1, 71B1) by the slit 76, and the slit 76 may be omitted.

The left and right second connection portions 70C each include a second press-fit portion 70C1 inserted (press-fitted) into the corresponding power source terminal insertion hole 38 in the fixed housing 30 from the lower side, and a second connection tab 70C2 extending toward the left-right direction outer side from a lower end of the second press-fit portion 70C1, such that each of the second connection portions 70C is formed in a substantially L-shape as viewed along the front-rear direction. An upper portion of the second press-fit portion 70C1 is formed with plural claws 78 that respectively project toward each front-rear direction side and are arranged along the up-down direction. The claws 78 dig into an inner peripheral face at the corresponding power source terminal insertion hole 38 such that the second press-fit portion 70C1 is retained by the fixed housing 30. The left and right second connection tabs 70C2 respectively project further toward the left-right direction outer side than the fixed housing 30. The second connection portions 70C are fixed (electrically connected) to the circuit board by soldering or the like.

The left and right second elastic portions 70B respectively extend integrally from the lower end of the second retained portion 70A1 of the second contact portion 70A toward each left-right direction side. The left and right second connection portions 70C extend integrally from respective end portions of the second elastic portions 70B on the opposite side to the second contact portion 70A. End portions on the second contact portion 70A side of the left and right second elastic portions 70B are inserted into the left and right elastic portion insertion grooves 26 formed in the lower face of the movable housing 14. Moreover, left-right direction intermediate portions of the left and right second elastic portions 70B configure second spring portions 70B1 that are bent into upward protrusions (toward the removal direction of the counterpart connector 12). Each of the second spring portions 70B1 is configured in an inverted U-shape opening toward the lower side as viewed along the front-rear direction. Parts of the left and right second elastic portions 70B (locations at substantially the halves on the second contact portion 70A side) are respectively housed in the left and right spring housing recesses 28 of the movable housing 14.

Operation and Advantageous Effects

Explanation follows regarding operation and advantageous effects of the present exemplary embodiment.

In the connector 10 configured as described above, the plural signal terminals 50 and the pair of power source terminals 70 span between the movable housing 14 and the pair of sidewalls 30A, 30B of the fixed housing 30. The plural signal terminals 50 are arrayed along the front-rear direction (terminal array direction X) that is orthogonal to both the up-down direction (insertion/removal direction Z) and the left-right direction (span direction Y). The first elastic portion SOB that is capable of undergoing elastic deformation is provided at a span direction Y intermediate portion of each of the signal terminals 50. The pair of power source terminals 70 are respectively disposed on each terminal array direction X side of the plural signal terminals 50, and span between the pair of sidewalls 30A, 30B. A span direction Y intermediate portion of each of the power source terminals 70 is retained by a terminal array direction X end portion of the movable housing 14, and each of the power source terminals 70 include the second elastic portions 70B that are each capable of undergoing elastic deformation at a location positioned between the movable housing 14 and the pair of sidewalls 30A, 30B.

In the connector 10, the first elastic portions SOB of the signal terminals 50 and the pair of second elastic portions 70B of the power source terminals 70 undergo elastic deformation so as to permit movement of the movable housing 14 relative to the fixed housing 30. This allows fitting misalignment between the connector 10 and the counterpart connector 12 to be absorbed.

Moreover, the connector 10 includes both signal terminals 50 and power source terminals 70, thus enabling the installation space required by the connector 10 on the circuit board to be reduced in comparison to cases in which a connector including signal terminals and a connector including power source terminals are attached to the circuit board separately to each other, and enabling the operation to assemble the connector 10 to the circuit board to be simplified.

Moreover, in the connector 10, the plural signal terminals 50 and the pair of power source terminals 70 span between the common movable housing 14 and the fixed housing 30, thereby enabling placement space required for the movable housing 14 in the terminal array direction X to be reduced in comparison to configurations in which plural movable housings are arranged along the terminal array direction X. Moreover, since the power source terminals 70 are each formed in an elongated shape with length along the span direction Y as viewed along the insertion/removal direction Z, the placement space required by the power source terminals 70 in the terminal array direction X can be reduced. Due to the above, the connector 10 according to the present exemplary embodiment enables a reduction in size of the overall configuration in the terminal array direction X.

In the connector 10, the second contact portion 70A provided at the span direction intermediate portion of each of the power source terminals 70 is retained by the terminal array direction X end portion of the movable housing 14. Since the second contact portion 70A makes electrical contact with the counterpart power source terminal provided at the counterpart connector 12 and undergoes elastic deformation toward the plural signal terminals 50, there is no need to secure a space for elastic deformation of the second contact portion 70A on the opposite side to the plural signal terminals 50 (on the terminal array direction X outer side). Moreover, the pair of second elastic portions 70B of each of the power source terminals 70 respectively extend toward each span direction Y side from the second contact portion 70A, thereby enabling a placement space for the pair of second elastic portions 70B in the terminal array direction X to be set smaller. Moreover, the pair of second connection portions 70C of each of the power source terminals 70 respectively extend toward the terminal array direction X outer side (toward the opposite side to the plural signal terminals 50) from the respective end portions of the pair of second elastic portions 70B on the opposite side to the second contact portion 70A. Setting the extension direction of the pair of second connection portions 70C in this manner enables the second contact portion 70A and the pair of second elastic portions 70B to be disposed closer to the plural signal terminals 50 than in a configuration in which the pair of second connection portions 70C extend toward the plural signal terminals 50 from the end portions of the pair of second elastic portions 70B on the opposite side to the second contact portion 70A. As a result, the movable housing 14 that retains the second contact portions 70A at the terminal array direction X end portions can be reduced in size along the terminal array direction X. Due to the above, the present exemplary embodiment enables a further reduction in size of the overall configuration of the connector 10 in the terminal array direction X.

Moreover, in the connector 10, the pair of second elastic portions 70B of each of the power source terminals 70 respectively extend toward each side in the span direction Y (branch toward each side in the span direction Y) from the second contact portion 70A. The second elastic portions 70B accordingly undergo elastic deformation more readily than in a configuration in which, for example, the pair of second elastic portions 70B of each of the power source terminals 70 branch in the terminal array direction X on one span direction Y side of the second contact portion 70A.

In the connector 10, the housing recesses 22 that respectively open toward the terminal array direction X outer side are formed in the terminal array direction X end portions of the movable housing 14. The housing recesses 22 house a large part of the second contact portions 70A of the power source terminals 70. This makes it easier to secure placement space for the second contact portions 70A when reducing the size of the overall configuration of the connector 10 in the terminal array direction X.

Moreover, in the connector 10, the terminal array direction X end portions of the movable housing 14 are each formed with the pair of spring housing recesses 28 respectively opening toward the terminal array direction X outer side and the span direction Y outer side. The pair of second elastic portions 70B of each of the power source terminals 70 are partially housed in the corresponding pair of spring housing recesses 28. This makes it easier to secure placement space for the pairs of second elastic portions 70B when reducing the size of the overall configuration of the connector 10 in the terminal array direction X.

In other words, the housing recesses 22 and the pairs of spring housing recesses 28 are formed in dead space within the placement space of the movable housing 14, and the second contact portions 70A and the pairs of second elastic portions 70B are partially housed within the respective recesses 22, 28. This makes it even easier to reduce the size of the overall configuration of the connector 10 in the terminal array direction X.

In the connector 10, the second contact portion 70A of each of the power source terminals 70 is formed in a plate shape having a plate thickness dimension in the terminal array direction X that is shorter than the width dimension in the span direction Y. The power source terminals 70 that include the second contact portions 70A require a large cross-sectional area to be secured since they carry a larger current than the signal terminals 50. Regarding this point, in the present exemplary embodiment the cross-sectional area of the second contact portions 70A is secured due to the width dimension described above, while the dimension of the second contact portions 70A in the terminal array direction X can be set small. The present exemplary embodiment thus makes it even easier to reduce the size of the overall configuration of the connector 10 in the terminal array direction X.

In the connector 10, the pair of second elastic portions 70B of each of the power source terminals 70 include the second spring portions 70B1 that are bent into protrusions toward the removal direction of the movable housing 14 (upward). The pair of second elastic portions 70B thus undergo elastic deformation more readily, while the terminal array direction X dimensions of the pair of second elastic portions 70B are set smaller.

Supplementary Explanation Regarding Exemplary Embodiment

In the exemplary embodiment described above, the pair of second contact points 71A1, 71B1 are provided arranged along the left-right direction (span direction Y) at the upper end portion of the second contact portion 70A of each of the power source terminals 70. However, there is no limitation thereto. For example, as in a power source terminal 70' (modified example) illustrated in FIG. 14, a pair of second contact portions 71C1, 71D1 may be provided arranged along the up-down direction (insertion/removal direction Z) at an upper end portion of a second contact portion 70A'.

The configuration of the power source terminal 70' is similar to that of the power source terminals 70 according to the exemplary embodiment described above, with the exception of the configuration of a second contact point elastic portion 70A1' of the second contact portion 70A'. The second contact point elastic portion 70A1' of the power source terminal 70' is formed with a slit (opening) 73 with a substantially inverted U-shape as viewed along the front-rear direction (terminal array direction X). The second contact point elastic portion 70A1' is thus divided into an outer divided portion 71C that has a substantially inverted U-shape as viewed along the front-rear direction, and an inner divided portion 71D disposed at the inside of the outer divided portion 71C.

Upper end portions of the outer divided portion 71C and the inner divided portion 71D are respectively provided with second contact points 71C1, 71D1 each protruding in a substantially circular arc shape toward the front-rear direction outer side. The second contact points 71C1, 71D1 are arranged in the up-down direction (insertion/removal direction Z), and project toward the front-rear direction outer side of the housing recess 22. The second contact points 71C1, 71D1 contact the corresponding counterpart power source terminal provided at the counterpart connector 12 to form an electrical connection between the power source terminal 70' and the counterpart power source terminal. Even if one out of the second contact points 71C1, 71D1 is damaged, this electrical connection is secured by the other out of the second contact points 71C1, 71D1.

Moreover, in the power source terminal 70', during insertion (connection) of the counterpart connector 12 into the connector 10, the second contact point 71C1 on the upper side slides against the counterpart power source terminal before the second contact point 71D1 on the lower side. Accordingly, even if, for example, an oxide layer has formed on the surface of the counterpart power source terminal, this oxide layer can be scraped off by this sliding, thereby enabling a good electrical connection to be formed between the second contact point 71D1 on the lower side and the counterpart power source terminal.

In the exemplary embodiment described above, the pair of second elastic portions 70B of each of the power source terminals 70 respectively extend toward each side in the span direction Y from the second contact portion 70A. In addition to this configuration, the pair of second elastic portions may further branch (divide) into plural elastic portions (spring portions) arranged in the terminal array direction X. In other words, it is sufficient that the power source terminal according to the present invention include at least a pair of second elastic portions respectively extending toward each span direction side from a second contact portion (contact portion).

Although the pair of second elastic portions 70B are bent so as to protrude toward the removal direction of the movable housing 14 in the exemplary embodiment described above, there is no limitation thereto. The shape of the pair of second elastic portions may be modified as appropriate. Moreover, although the second contact portion 70A is formed in a plate shape with a smaller plate thickness dimension in the terminal array direction X than the width dimension in the span direction Y in the exemplary embodiment described above, there is no limitation thereto, and the shape of the second contact portion (the contact portion of the power source terminal) may be modified as appropriate.

Although in the exemplary embodiment described above, the housing recess 22 and the pair of spring housing recesses 28 are formed in each of the terminal array direction X end portions of the movable housing 14, there is no limitation thereto, and one or both out of the housing recess or the pair of spring housing recesses may be omitted.

Various other modifications may be implemented within a range not departing from the spirit of the present invention. The scope of rights of the present invention is obviously not limited by the exemplary embodiment described above.

The disclosure of Japanese Patent Application No. 2017-196774, filed on Oct. 10, 2017, is incorporated in its entirety by reference herein. All cited documents, patent applications, and technical standards mentioned in the present specification are incorporated by reference in the present specification to the same extent as if each individual cited document, patent application, or technical standard was specifically and individually indicated to be incorporated by reference.

The invention claimed is:

1. A connector comprising:

a movable housing configured to have a connection target inserted into and removed from the movable housing;

a fixed housing that is fixed to a circuit board and that includes a pair of sidewalls respectively disposed on each side in a span direction orthogonal to an insertion/removal direction of the connection target with respect to the movable housing;

a plurality of signal terminals that are arrayed in a terminal array direction orthogonal to both the insertion/removal direction and the span direction, each of the signal terminals spanning along the span direction between the movable housing and a respective sidewall of the pair of sidewalls and including a first elastic portion capable of undergoing elastic deformation at a span direction intermediate portion of the signal terminal; and a power source terminal that is disposed on one side of the plurality of signal terminals in the terminal array direction, the power source terminal being formed in an elongated shape with a length in the span direction as viewed along the insertion/removal direction, spanning between the pair of sidewalls, including a span direction intermediate portion retained by a terminal array direction end portion of the movable housing, and including second elastic portions each capable of undergoing elastic deformation at a location positioned between the movable housing and the pair of sidewalls, the power source terminal including a contact portion provided at the span direction immediate portion and configured to form an electrical contact with the connection target and to undergo elastic deformation toward the plurality of signal terminals.

2. The connector of claim 1, wherein the power source terminals includes:

a pair of the second elastic portions respectively extending from the contact portion toward each side in the span direction; and a pair of connection portions respectively extending toward an outer side in the terminal array direction from respective end portions of the pair of second elastic portions on an opposite side from the contact portion, the pair of connection portions being retained by the fixed housing and fixed to the circuit board.

3. The connector of claim 1, wherein the terminal array direction end portion of the movable housing is formed with a housing recess opening toward the outer side in the terminal array direction and configured to house at least a part of the contact portion.

4. The connector of claim 2, wherein the terminal array direction end portion of the movable housing is formed with a pair of spring housing recesses respectively opening toward a respective outer side in the terminal array direction and each outer side in the span direction, and configured to house at least a part of a respective second elastic portion of the pair of second elastic portions.

5. A connector comprising:

a movable housing configured to have a connection target inserted into and removed from the movable housing;

a fixed housing that is fixed to a circuit board and that includes a pair of sidewalls respectively disposed on each side in a span direction orthogonal to an insertion/removal direction of the connection target with respect to the movable housing;

a plurality of signal terminals that are arrayed in a terminal array direction orthogonal to both the insertion/removal direction and the span direction, each of the signal terminals spanning along the span direction between the movable housing and a respective sidewall of the pair of sidewalls and including a first elastic portion capable of undergoing elastic deformation at a span direction intermediate portion of the signal terminal; and a power source terminal that is disposed on one side of the plurality of signal terminals in the terminal array direction, the power source terminal being formed in an elongated shape with a length in the span direction as viewed along the insertion/removal direction, spanning between the pair of sidewalls, including a span direction intermediate portion retained by a terminal array direction end portion of the movable housing, and including second elastic portions each capable of undergoing elastic deformation at a location positioned between the movable housing and the pair of sidewalls, the power source terminal including a contact portion provided at the span direction immediate portion and configured to form an electrical contact with the connection target, the terminal array direction end portion of the movable housing is formed with a housing recess opening toward the outer side in the terminal array direction and configured to house at least a part of the contact portion.

* * * * *